United States Patent [19]

Heitmann et al.

[11] 4,287,754

[45] Sep. 8, 1981

[54] APPARATUS FOR AND METHOD OF MULTIPLE TESTING OF WRAPPERS OF CIGARETTES OR THE LIKE

[75] Inventors: Uwe Heitmann, Schwarzenbek; Heinz-Christen Lorenzen, Hamburg; Günter Wahle, Reinbek; Rolf Dahlgrün, Schwarzenbek, all of Fed. Rep. of Germany

[73] Assignee: Hauni-Werke Korber & Co. KG, Hamburg, Fed. Rep. of Germany

[21] Appl. No.: 154,291

[22] Filed: May 29, 1980

Related U.S. Application Data

[63] Continuation of Ser. No. 852,963, Nov. 18, 1977, abandoned.

[30] Foreign Application Priority Data

Nov. 26, 1976 [DE] Fed. Rep. of Germany ..... 2653734

[51] Int. Cl.[3] ..... G01N 15/08

[52] U.S. Cl. ..... 73/38; 73/45.1

[58] Field of Search ..... 73/38, 41, 45, 45.1, 73/45.2

[56] References Cited

U.S. PATENT DOCUMENTS 3,690,149 9/1972 Pezzi ..... 73/38

3,913,381 10/1975 Heitmann ..... 73/45.1

*Primary Examiner*—Gerald Goldberg

*Assistant Examiner*—Joseph W. Roskos

*Attorney, Agent, or Firm*—Peter K. Kontler

[57] ABSTRACT

The wrappers of filter cigarettes or analogous rod-shaped articles which constitute or form part of smokers' products and wherein portions of the wrappers have perforations are tested while moving sideways in the flutes of an endless conveyor. The testing involves establishing a less pronounced pressure differential between the interior and exterior of unperforated wrapper portions and a more pronounced pressure differential between the interior and exterior of perforated wrapper portions. An electropneumatic transducer generates first signals which denote the rate of fluid flow through the perforated and unperforated wrapper portions. Such signals are compared with first and second reference signals which respectively denote the maximum permissible and minimum acceptable permeability of wrappers, and the articles wherein the permeability of wrappers exceeds the maximum permissible permeability or is less than the minimum acceptable permeability are segregated from other articles.

22 Claims, 5 Drawing Figures

Fig.2
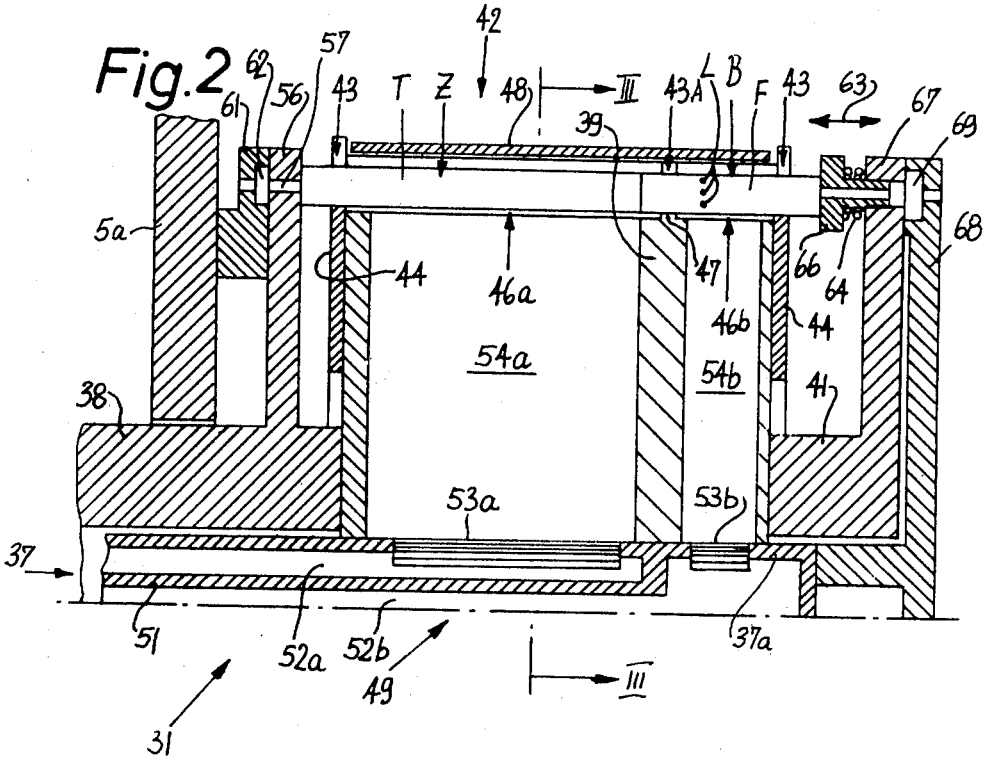
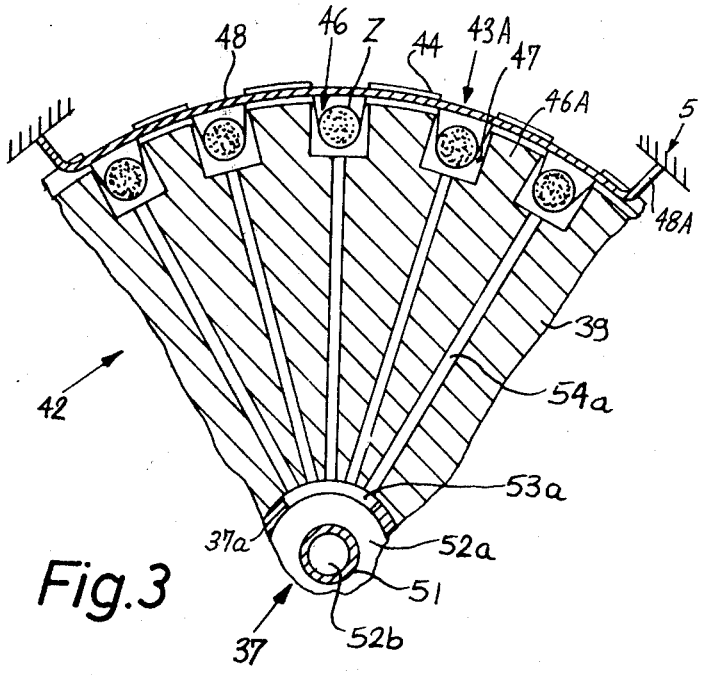
Fig.3

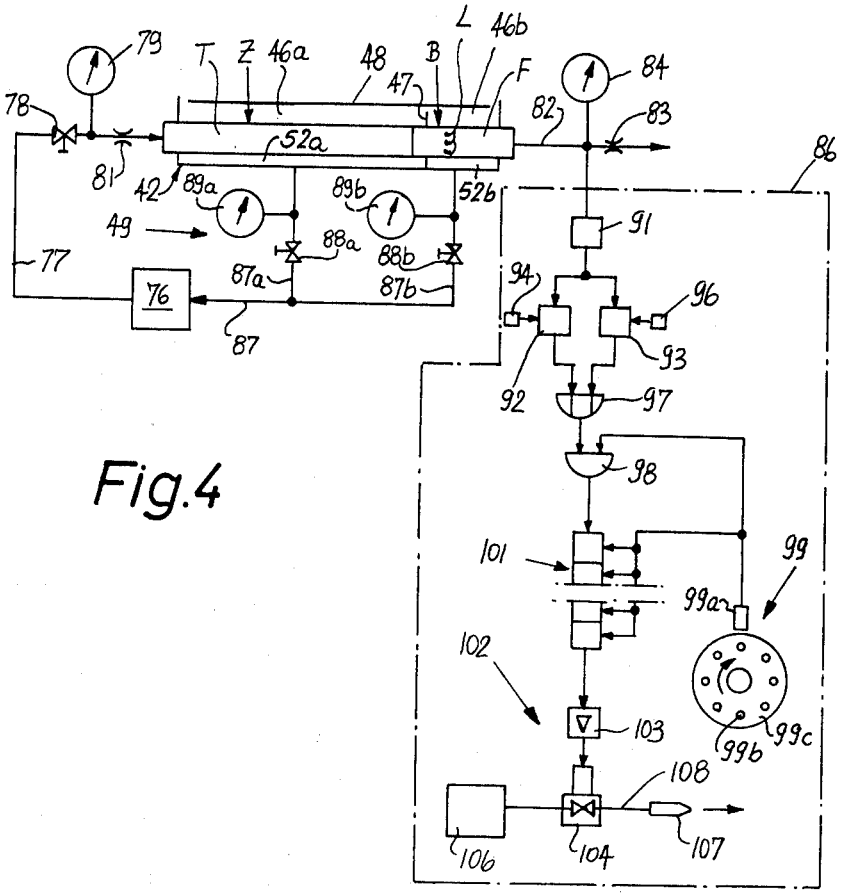
Fig.4
Fig.5
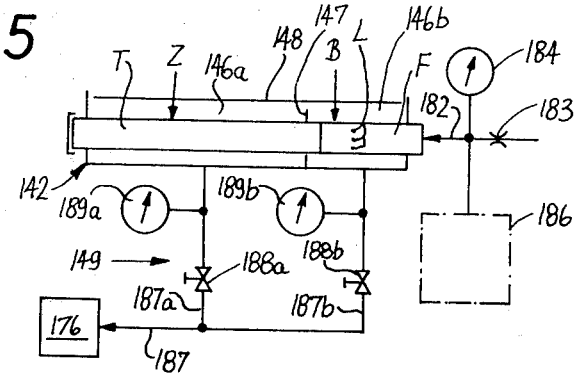

APPARATUS FOR AND METHOD OF MULTIPLE TESTING OF WRAPPERS OF CIGARETTES OR THE LIKE

This is a continuation of application Ser. No. 852,963, filed Nov. 18, 1977, now abandoned.

BACKGROUND OF THE INVENTION

The present invention relates to a method and apparatus for testing the wrappers of rod-shaped articles (including plain or filter-tipped cigarettes, cigars, cigarillos and cheroots as well as filter rod sections) which constitute or form part of smokers' products. More particularly, the invention relates to a method and apparatus for ascertaining the permeability of wrappers of rod-shaped articles (hereinafter referred to as cigarettes or filter cigarettes) of the type wherein each wrapper includes a portion of greater (predetermined) permeability so that it allows cool atmospheric air to enter the column of tobacco smoke flowing into the smoker's mouth.

It is already known to provide the wrappers of cigarettes with holes or perforations which admit cool atmospheric air into the column of tobacco smoke. The perforated portions of wrappers constitute the so-called climatic zones which are normally adjacent to unlighted ends of the cigarettes. For example, the wrapper of a filter cigarette will be provided with perforations in that portion which surrounds or is closely adjacent to the mouthpiece; this insures that cool atmospheric air will flow into the column of tobacco smoke regardless of the length of non-combusted portion of the tobacco-containing part of the smokers' product. Devices which can be used to perforate selected portions of wrappers of filter cigarettes or the like are disclosed in commonly owned copending applications Ser. Nos. 834,635 filed Sept. 19, 1977 by Heitmann et al., 841,108 filed Oct. 11, 1977 by Wahle et al., and 864,441 filed Dec. 27, 1977 by Lüders et al.

Many manufacturers of smokers' products demand that the machines which produce cigarettes, cigars or cigarillos be equipped with perforating devices so as to allow a predetermined quantity of atmospheric air to mix with tobacco smoke which flows toward the mouth. The admixture of atmospheric air to smoke is considered to be desirable because it is believed to reduce the health hazards involved in smoking of tobacco by controlling the amount of nicotine and condensates in the smoke. The packages for cigarettes or other smokers' products must bear information indicating the nicotine content, the tar content and the percentage of certain other ingredients, and the manufacturer is responsible for the accuracy of such information. One of the factors which influence the quantity of nicotine and condensates in the column of tobacco smoke is the quantity of admitted atmospheric air; therefore, it is important to insure that the quantity of admitted air will invariably equal or even slightly exceed a predetermined minimum acceptable value. Consequently, it is necessary to ascertain whether or not the combined cross-sectional area of perforations in the wrappers suffices to guarantee admission of the minimum required quantity of atmospheric air. Furthermore, it is desirable to ascertain the permeability of a finished wrapper (i.e., of the tubular wrapper of a filter cigarette or the like) because this is the only reliable mode of determining the permeability of perforated wrapper portions. For example, certain perforations can be clogged by particles of tobacco or filter material so that, even if the permeability of wrapping material upstream of the wrapping station is clearly adequate, the permeability of perforated portion of the finished wrapper will be too low.

Automatic testing of wrappers of cigarettes or the like for the presence of open seams, holes, frayed ends and other defects is known for nearly two decades. The first successful automatic testing apparatus is disclosed in commonly owned U.S. Pat. No. 3,408,858 to Heinz Kaeding. As a rule, one establishes a pressure differential between the interior and exterior of the wrapper. The pressure differential decreases when the wrapper is defective, e.g., due to the presence of a partly open seam. This is detected by a transducer which furnishes signals to a signal comparing stage (e.g., a threshold circuit) which actuates an ejector when the intensity or another characteristic of the signal is indicative of a defective article. The ejector segregates each defective article from satisfactory articles, for example, by directing streams of compressed air against the ends or sides of defective articles. Presently known testing apparatus are sufficiently accurate to effect the segregation of cigarettes or analogous rod-shaped articles having wrappers which are defective because their permeability exceeds the acceptable permeability by a value corresponding to that which is attributable to the presence of a hole with a diameter of approximately one millimeter. Deviations which are less pronounced cannot be ascertained with a requisite degree of accuracy and reproducibility because the results of tests are influenced by unavoidable factors such as unequal sealing of wrapper ends on successive articles during testing, deviation of density of the tobacco filler from an optimum value, wear upon moving parts of the testing apparatus, clogging of narrow passages in such apparatus by tobacco dust or other foreign matter and/or others. On the other hand, the increased permeability of intentionally perforated portions of wrappers of filter cigarettes or the like is less pronounced than that permeability which is attributable to the presence of a hole with a diameter of one millimeter. Moreover, it is desirable to insure that the permeability of intentionally perforated portions of the wrappers should not deviate from (above or below) an optimum permeability by more than two percent.

OBJECTS AND SUMMARY OF THE INVENTION

An object of the invention is to provide a novel and improved method of ascertaining the permeability of wrappers of rod-shaped articles which constitute or form part of smokers' products and wherein predetermined portions of wrappers must exhibit a predetermined permeability.

Another object of the invention is to provide a method which insures the detection of all articles whose wrappers exhibit excessive permeability (for example, due to the presence of large holes or open seams) as well as the detection of articles wherein the permeability of intentionally perforated (predetermined) wrapper portions deviates from an optimum value.

A further object of the invention is to provide a novel and improved method of multiple testing of wrappers of cigarettes or the like.

An additional object of the invention is to provide a method which allows for multiple testing of cigarettes or analogous rod-shaped articles at the rate at which such articles are produced in or issue from a modern high-speed maker, e.g., a filter cigarette making machine which turns out up to and in excess of 70 filter cigarettes per second.

Still another object of the invention is to provide a novel and improved apparatus for the practice of the above outlined method.

A further object of the invention is to provide a compact and relatively simple apparatus which can be readily installed in existing makers of cigarettes or the like.

One feature of the invention resides in the provision of a method of testing the wrappers of cigarettes or analogous rod-shaped articles which constitute or form part of smokers' products. The method comprises the steps of measuring—with a first degree of accuracy—the permeability of a first portion of the wrapper of each of a series of successive articles, measuring—with a second degree of accuracy—the permeability of a second portion of each wrapper of the same series of articles, generating a succession of first signals having characteristics denoting the measured permeabilities of first and second portions of wrappers of successive articles, comparing each first signal with a first reference signal denoting the maximum permissible permeability of the wrappers, and comparing the first signals with a second reference signal denoting the minimum acceptable permeability of the wrappers.

The first mentioned measuring step preferably includes establishing a first pressure differential between the interior and exterior of successive first wrapper portions, and the last mentioned measuring step preferably includes establishing a different second pressure differential between the interior and exterior of successive second wrapper portions. The second wrapper portions have holes for admission of atmospheric air into the column of smoke; such holes are formed in the wrappers prior to the last mentioned measuring step, and the second degree of accuracy preferably exceeds the first degree of accuracy, i.e., the second pressure differential is more pronounced than the first pressure differential if the second wrapper portions are provided with so-called climatic zones, namely, with zones having intentionally formed air-admitting holes.

The first signals may constitute pneumatic or electric signals.

The method preferably further comprises the step of segregating from the series of articles those articles wherein the permeability of the wrapper is outside of the range between the maximum permissible and minimum acceptable permeabilities. If the articles of the series are moved sideways along a predetermined path in the course of the measuring steps, the segregating step preferably includes generating an additional signal whenever the intensity (or another characteristic) of a first signal exceeds the intensity of the first reference signal or is less than the intensity of the second reference signal, and utilizing the additional signals for ejection of corresponding articles from the path.

The novel features which are considered as characteristic of the invention are set forth in particular in the appended claims. The improved testing apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is an enlarged fragmentary axial sectional view of a conveyor which forms part of the testing apparatus, the section being taken in the direction of arrows as seen from the line II—II of FIG. 1;

FIG. 3 is a fragmentary transverse vertical sectional view as seen in the direction of arrows from the line III—III of FIG. 1;

FIG. 4 is a diagrammatic view of the testing apparatus which includes the conveyor of FIGS. 2 and 3; and FIG. 5 is a similar diagrammatic view of a modified testing apparatus.

DESCRIPTION OF THE PREFERRED EMBODIMENTS

Figure 1:
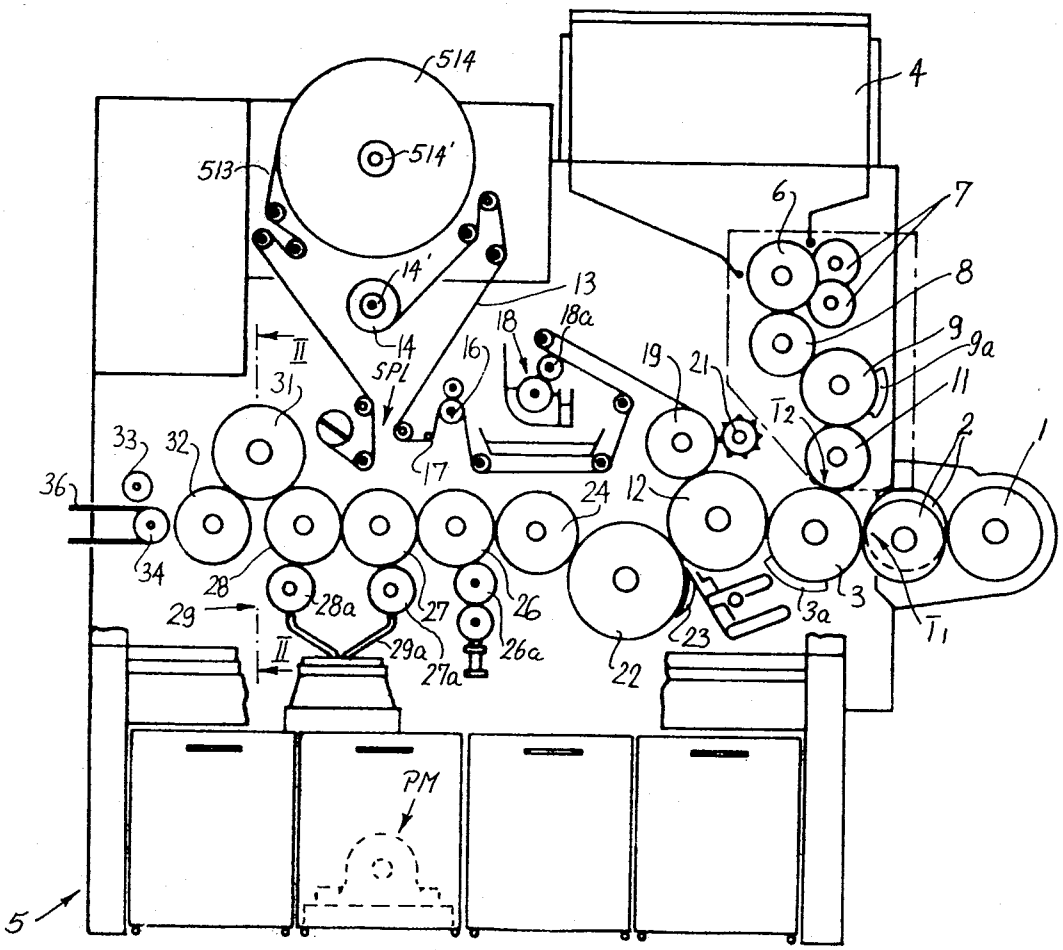
FIG. 1 is a schematic elevational view of a filter cigarette making machine including a testing apparatus which embodies one form of the invention.

FIG. 1 shows a filter cigarette making machine of the type known as MAX S (produced by the assignee of the present application). The machine is directly coupled to a maker of plain cigarettes of unit length, e.g., to a machine known as GARANT (trademark) produced by the assignee of the present application. The maker comprises a rotary drum-shaped row forming conveyor 1 which is mounted in or on the frame 5 of the filter cigarette making machine and has peripheral flutes for continuous delivery of two rows of plain cigarettes of unit length. The flutes of the conveyor 1 are parallel to its axis, i.e., the cigarettes are transported sideways. The cigarettes of one row are admitted into the oddly numbered flutes and the cigarettes of the other row are admitted into the evenly numbered flutes of the conveyor 1. Furthermore, the cigarettes of one row are adjacent to one axial end and the cigarettes of the other row are adjacent to the other axial end of the conveyor 1.

The filter cigarette making machine comprises a pair of rotary drum-shaped aligning conveyors 2 which are mounted in the frame 5 adjacent to the row forming conveyor 1 and have peripheral flutes for sidewise transport of plain cigarettes toward a transfer station T1. One of the conveyors 2 receives successive plain cigarettes of one row and the other conveyor 2 receives successive plain cigarettes of the other row. The conveyors 2 are driven at different speeds and/or transport the plain cigarettes of the respective rows through different distances so that each flute of a rotary drum-shaped assembly conveyor 3 which arrives at the transfer station T1 receives a pair of coaxial plain cigarettes of unit length. The plain cigarettes of each pair are separated from each other by a gap having a width which at least equals the length of a filter rod section or mouthpiece of double unit length.

The upper portion of the frame 5 supports a magazine 4 for filter rod sections of six times unit length. The outlet of the magazine 4 receives a portion of a rotary drum-shaped severing conveyor 6 having peripheral flutes which remove filter rod sections from the magazine 4 and transport them past two rotary disk-shaped knives 7 which are staggered with respect to each other, as considered in the axial and circumferential directions of the conveyor 6. The latter cooperates with the knives 7 to subdivide each filter rod section of six times unit length into sets of three coaxial filter rod sections of double unit length. The filter rod sections of each set are transferred into the peripheral flutes of three rotary drum-shaped staggering conveyors 8 (only one shown) which rotate at different speeds and/or transport the respective filter rod sections of double unit length through different distances to thereby stagger the sections in the circumferential direction of the illustrated conveyor 8. The staggering conveyors 8 deliver discrete filter rod sections of double unit length into successive flutes of a rotary drum-shaped shuffling conveyor 9 which cooperates with two stationary cams 9*a* to convert the filter rod sections into a single row wherein each preceding section is in exact register with the next-following section. Successive sections of the thus obtained row are delivered into successive flutes of a rotary drum-shaped accelerating conveyor 11 which deposits the sections in successive flutes of the assembly conveyor 3 at a second transfer station T2 preceding the station T1. Each inserted filter rod section of double unit length is positioned in such a way that it is flanked by two coaxial plain cigarettes of unit length after the respective flute of the conveyor 3 advances beyond the station T1. The thus obtained groups of three coaxial rod-shaped articles each (a filter rod section of double unit length and two plain cigarettes of unit length) are thereupon caused to move through the gap between two stationary condensing cams 3*a* which move the inner ends of plain cigarettes into actual abutment with the respective ends of the associated filter rod section. The condensed groups are delivered into the flutes of a rotary drum-shaped transfer conveyor 12.

The frame 5 of the filter cigarette making machine further supports a spindle 14' for a roll 14 of convoluted wrapping material which constitutes an elongated web 13 consisting of cigarette paper, artificial cork or the like. The web 13 is drawn off the roll 14 by two advancing rolls 16 at least one of which is driven by the prime mover PM of the filter cigarette making machine and the other of which is preferably biased againt the one roll. Successive increments of the web 13 are caused to pass along the relatively sharp edge of a curling device 17 of the type disclosed in the commonly owned U.S. Pat. No. 3,962,957 granted June 15, 1976 to Alfred Hinzmann. The purpose of the curling device 17 is to eliminate and/or equalize internal stresses in the material of the web 13. One side of the running web 13 is coated with a suitable adhesive by the rotary applicator 18*a* of a paster 18 which is installed in the frame 5 downstream of the advancing rolls 16. The leader of the web 13 adheres to the periphery of a rotary suction drum 19 which cooperates with a rotary knife 21 to subdivide the web 13 into a succession of discrete adhesive-coated uniting bands. Such bands are attached to successive groups of rod-shaped articles on the transfer conveyor 12, preferably in such a way that each band extends tangentially of the respective group and adheres to the respective filter rod section as well as to the inner end portions of the adjacent plain cigarettes.

A second spindle 514' supports a roll 514 consisting of convoluted wrapping material which constitutes an elongated web 513. The leader of the web 513 is located at a splicing station SPL which includes means for attaching the leader of the web 513 to the running web 13 when the diameter of the roll 14 is reduced to a predetermined minimum value. The splicing device at the splicing station SPL may be of the type disclosed in the commonly owned U.S. Pat. No. 3,586,006 granted June 22, 1971 to Gerd-Joachim Wendt.

Successive groups in the flutes of the transfer conveyor 12 (each such group carries a discrete uniting band) are delivered to a rotary drum-shaped wrapping conveyor 22 which cooperates with a stationary or mobile rolling device 23 to roll successive groups around their respective axes and to thus convert the respective uniting bands into tubes which sealingly surround the filter rod sections and the inner ends of plain cigarettes of the respective groups, i.e., each such group is converted into a filter cigarette of double unit length. The wrapping conveyor 22 delivers successive filter cigarettes of double unit length into the flutes of a rotary drum-shaped heating or drying conveyor 24 which insures that the adhesive on each tube sets prior to transfer into the flutes of a rotary drum-shaped severing conveyor 26 cooperating with a rotary disk-shaped knife 26*a* which severs each filter cigarette of double unit length midway across the tube so that such cigarettes yield pairs of coaxial filter cigarettes Z (see FIG. 2) of unit length (hereinafter called cigarettes for short). Defective cigarettes Z (e.g., those without a filter plug or tobacco-containing portion) are ejected during travel along the periphery of the severing conveyor 26.

The conveyor 26 delivers pairs of cigarettes Z to the rotary drum-shaped conveyor 27 of a turn-around device 29 of the type disclosed in commonly owned U.S. Pat. No. 3,583,546 granted June 8, 1971 to Gerhard Koop. One cigarette of each pair is transferred onto a second conveyor 27*a* and is inverted through 180 degrees by one of several orbiting arms 29*a*. The other cigarettes of successive pairs are transferred into alternate flutes of a third rotary drum-shaped conveyor 28 of the device 29. A fourth conveyor 28*a* of the device 29 delivers inverted cigarettes into empty flutes of the conveyor 28 so that the inverted cigarettes are disposed between neighboring non-inverted cigarettes and the cigarettes form a single row wherein the filter mouthpieces of all cigarettes face in the same direction.

The conveyor 28 delivers successive cigarettes of the single row to a rotary drum-shaped conveyor 31 forming part of a testing apparatus wherein the wrappers of cigarettes are monitored to ascertain whether or not the wrappers are satisfactory. Cigarettes having defective wrappers are segregated from satisfactory cigarettes during travel with a rotary drum-shaped conveyor 32 which is located downstream of the conveyor 31 and delivers satisfactory cigarettes onto the upper reach of a belt conveyor 36 trained over pulleys 34 (one shown). The illustrated pulley 34 cooperates with a rotary braking drum 33. The conveyor 36 delivers satisfactory cigarettes into storage, into chargers, to a pneumatic sender or directly into the magazine of a packing machine, not shown.

The conveyor 32 preferably cooperates with a conventional testing unit serving to ascertain the density of tobacco-containing ends of cigarettes Z and to effect segregation of cigarettes wherein the density of tobacco-containing ends is unsatisfactory. The segregation of cigarettes having unsatisfactory tobacco-containing ends can take place at the ejecting or segregating station for cigarettes having defective wrappers.

FIGS. 2 and 3 illustrate certain details of the testing apparatus which includes the conveyor 31 of FIG. 1. In many respects, the testing apparatus which is used in the filter cigarette making machine of FIG. 1 operates (or can operate) in a manner known from presently used testing apparatus for rod-shaped articles which constitute or form part of smokers' products. The operation is based on the principle that one establishes a pressure differential between the interior and exterior of the wrapper and monitors the magnitude or extent of such pressure differential. The pressure can be higher in the interior of or around the wrapper, and the monitoring step can include measuring the rise of pressure at the lower-pressure side and/or measuring the drop of pressure at the higher-pressure side of the wrapper. As a rule, the testing fluid is air; however, it is clear that many other gases can be used with equal advantage. A suitable testing apparatus which can be used, with certain modifications, for the purposes of the present invention is disclosed in commonly owned U.S. Pat. No. 3,948,084 granted Apr. 6, 1976 to Bob Heitmann et al. to which reference may be had for all such details which are not fully shown in the drawing of the present application.

FIGS. 2 and 3 show a hollow shaft 37 which supports the components of the testing conveyor 31. Such components include three coaxial rotary members 38, 39 and 41 which together constitute a drum-shaped main body portion 42 of the conveyor. The means for transmitting torque from the prime mover PM to the main body portion 42 is of conventional design. The median rotary member 39 is flanked by two disks 44 whose peripheral portions define annuli of article-receiving cradles or sockets 43. Each socket 43 of the left-hand disk 44 of FIG. 2 is in register with a socket 43 of the right-hand disk 44. The conveyed articles are filter cigarettes Z of unit length; each such cigarette comprises a filter mouthpiece F of unit length and a plain cigarette T of unit length. These parts are sealingly secured to each other by one-half of a convoluted uniting band B which is obtained in response to severing of the web 13 in a manner shown in FIG. 1. The rotary member 39 is formed with peripheral chambers or recesses 46 each of which is disposed between and aligned with two registering sockets 43. Still further, the rotary member 39 has an external ring 47 with an annulus of cradles 43A which receive the filter mouthpieces F in regions close to the adjacent inner ends of the plain cigarettes T. The cradles 43A can be said to constitute partitions which divide the respective recesses 46 into first and second compartments **46*a* and 46*b*. The compartments 46*a* receive the major portions of plain cigarettes T and the compartments 46*b* receive portions of filter mouthpieces F of cigarettes Z in the respective recesses 46. The convoluted uniting bands or tubes B which surround the filter mouthpieces F and the adjacent inner end portions of plain cigarettes T have portions of predetermined or desired permeability which is attributable to the provision of holes L adjacent to the right-hand side of the cradle 43A shown in FIG. 2. The manner in which the holes can be formed in the uniting bands B, either prior or subsequent to draping of uniting bands around the respective groups of coaxial articles, is disclosed, for example, in commonly owned copending application Ser. No. 841,108 of Wahle et al. and in commonly owned copending application Ser. No. 864,441 of Lüders et al. Reference may be had to these commonly owned applications for the details of perforating devices which can be employed to provide the bands B with predetermined portions of desired permeability. The application of Wahle et al. discloses that the perforating device may comprise needles, punching tools, spark generators and/or one or more lasers. Such device can be located between the roll 14 and drum 19 of FIG. 1 or adjacent to one of the conveyors which transport groups or rod-shaped articles, filter cigarettes of double unit length or filter cigarettes Z of unit length toward the conveyor 31. For example, a perforating device employing one or more sets of needles can be placed adjacent to the path of freshly formed filter cigarettes of double unit length on the wrapping conveyor 22 of FIG. 1**.

The testing apparatus which includes the structure of FIGS. 2 and 3 further comprises an arcuate sealing element or shroud 48 which is disposed between the disks 44 and overlies the open outer ends of several neighboring recesses 46. The shroud 48 is secured (preferably pivoted) to the frame 5, as at 48A. The concave inner side of the shroud 48 is preferably closely adjacent to the projections 46A between neighboring recesses 46 of the rotary member 39 so that the compartments **46*a*, 46*b* which travel along the concave side of the shroud 48 are substantially sealed from the surrounding atmosphere. FIG. 3 shows that the width of gaps between the shroud 48 and the rotary member 39** is negligible.

The pressure of fluid in compartments **46*a* which travel along the concave inner side of the shroud 48 is different from the pressure of fluid in the associated compartments 46*b*. The means 49 for maintaining the pressure in compartments 46*a*, 46*b* at different levels includes an annular partition or wall 51 which is provided in and divides the interior of the shaft 37 into two discrete spaces 52*a* and 52*b*. The spaces 52*a*, 52*b* are connected with the suction intake of a blower or another suitable source 76 of compressed gas (see FIG. 4). The cylindrical outer wall 37*a* of the shaft 37 (which is stationary) has a relatively long slot 53*a* which is parallel to the axis of the shaft 37 and establishes communication between the space 52*a* and a certain number (including one) of channels 54*a* machined into the rotary member 39. Each channel 54*a* communicates with a discrete compartment 46*a*. The outer wall 37*a* of the shaft 37 is further formed with a second slot 53*b* which is aligned with the slot 53*a* and connects the space 52*b* with a certain number (including one) of channels 54*b* also machined into the rotary member 39 and each communicating with a different compartment 46*b*. The illustrated arrangement is such that, when a compartment 46*a* communicates with the space 52*a*, the aligned compartment 46*b* communicates with the space 52*b***.

The rotary member 38 has a ring-shaped flange 56 with holes 57 each of which is in register with a socket 43 in the adjacent disk 44. The flange 56 rotates with respect to a stationary valve plate 61 having an arcuate groove 62 which communicates with successive bores 57 when the conveyor 31 rotates about the axis of the shaft 37. The groove 62 receives compressed testing fluid from the pressure outlet of the blower 76 so that such fluid penetrates into the interior of the wrapper of the cigarette Z which advances past the groove 62. The flange 56 seals the left-hand ends of the wrappers of cigarettes Z save for the relatively small regions which register with the respective holes 57. The valve plate 61 is biased against the outer side of the flange 56 to prevent uncontrolled escape of testing fluid from or uncontrolled admission of atmospheric air into the groove 62. A member **5*a* of the frame 5 supports the valve plate 61 adjacent to the path of movement of the flange 56**.

The rotary member 41 has a flange 67 which carries an annulus of reciprocable sealing elements 66 here shown as nipples which are biased by helical springs 64 so that they bear against the right-hand ends of wrappers of cigarettes Z on the conveyor 31. Each nipple 66 is in register with a socket 43 in the adjacent disk 44, and each such nipple is movable in directions indicated by the double-headed arrow 63. A suitable stationary cam (not specifically shown) is mounted in the frame 5 and cooperates with roller followers of the nipples 66 to retract the nipples ahead of the transfer station between the conveyors 28, 31 and again ahead of the transfer station between the conveyors 31, 32 so as to allow for unobstructed introduction of cigarettes Z into the respective sockets 43 and 43A. Once a cigarette Z enters the respective sockets, the cam allows the springs 64 to expand and to move the nipples 66 into sealing engagement with the adjacent ends of the wrappers of cigarettes Z; at the same time, the nipples 66 push the respective cigarettes Z against the flange 56. Alternatively, the nipples can be moved by a wobble plate in a manner as disclosed in the aforementioned U.S. Pat. No. 3,948,084 to Heitmann et al.

Each nipple 66 has an axial passage which can receive compressed testing fluid from the respective end of the aligned wrapper. Such compressed fluid is admitted into an arcuate groove 69 in a second stationary valve plate 68 which is outwardly adjacent to the flange 67. Each of the grooves 62, 69 can be connected with a device (see the gauges 79, 84 of FIG. 4) which measures the pressure of testing fluid and furnishes appropriate signals indicative of the measured pressure.

The testing apparatus of FIG. 4 includes the aforementioned blower 76 which constitutes a suction generating device for the compartments **46*a*, 46*b* of successive chambers or recesses 46 in the conveyor 31 as well as a source of compressed testing fluid (air) for the groove 62 of the valve plate 61. The pressure outlet of the blower 76 is connected with the groove 62 by a pipe 77 which contains a pressure regulating valve 78, the aforementioned pressure gauge 79 and a preferably adjustable flow restrictor 81. Compressed testing fluid which is admitted into the wrappers of successive cigarettes Z via groove 62 and the respective bores 57 flows axially through the wrappers and into the axial passages of the respective nipples 66 to enter the groove 69 of the valve plate 68. The groove 69 communicates with a pipe 82 which contains the aforementioned pressure gauge 84 and a preferably adjustable flow restrictor 83. The discharge end of the pipe 82 communicates with the atmosphere and a branch of this pipe is connected with the electropneumatic transducer 91 of a measuring circuit 86. The inertia of the pressure gauge 84** is preferably high (such gauge may be of the type known as encapsulated spring gauge).

The intake of the blower 76 is connected with the compartments **46*a*, 46*b* of successive chambers or recesses 46 by the air withdrawing unit 49 which comprises a pipe 87 having two branches 87*a*, 87*b* which are respectively connected with the spaces 52*a*, 52*b* of the shaft 37 and respectively contain pressure regulating valves 88*a*, 88*b* and pressure gauges 89*a*, 89*b***.

The transducer 91 may be of the type disclosed in commonly owned U.S. Pat. No. 3,412,856 to Esenwein. The output of this transducer is connected with the first inputs of two signal comparing threshold circuits 92, 93. The second input of the threshold circuit 92 receives a first reference signal from a suitable source 94 (e.g., an adjustable potentiometer), and the second input of the threshold circuit 93 receives a second reference signal from a source 96. The reference signal which is transmitted by the source 94 denotes the maximum permissible permeability of a wrapper, and the reference signal which is furnished by the source 96 denotes the minimum acceptable permeability of the predetermined (perforated) portion of a wrapper. The output of the threshold circuit 92 transmits a signal to one input of an OR-gate 97 when the intensity or another characteristic of the signal at the output of the transducer 91 exceeds the intensity or another characteristic of the reference signal from the source 94, i.e., when the permeability of the wrapper between the grooves 62 and 69 is excessive. The output of the threshold circuit 93 transmits a signal to the other input of the OR-gate 97 when the intensity or another characteristic of the signal at the output of the transducer 91 is less than the intensity of reference signal furnished by the source 96, i.e., when the permeability of the entire wrapper or at least the predetermined portion of the wrapper between the grooves 62, 69 is too low.

The output of the OR-gate 97 is connected with one input of an AND-gate 98 the other input of which is connected to the proximity switch **99*a* of a pulse generator or synchronizing means 99 having a rotary disk 99*c* provided with magnets 99*b*. The switch 99*a* transmits a signal when a magnet 99*b* travels therealong. The disk 99*c* is driven in synchronism with the conveyor 31** by the main prime mover PM of the filter cigarette making machine.

The output of the AND-gate 98 is connected with the first stage of a shift register 101 which receives signal transporting pulses from the proximity switch **99*a* and the last stage of which is connected with the amplifier 103 of a segregating device 102. The latter further comprises a normally closed solenoid-operated valve 104 which can be opened by the amplifier 103 and is installed in a conduit 108 connecting a source 106 of compressed air with an ejector nozzle 107. The nozzle 107 is adjacent to the path of movement of cigarettes Z in the flutes of the conveyor 32 and receives a stream of compressed air when a defective cigarette is in register with its outlet. The nozzle 107 can be placed adjacent to one axial end of the conveyor 32 or it may be installed in the interior of the conveyor 32** so as to expel the defective cigarettes radially outwardly.

The operation is as follows:

Successive chambers or recesses 46 of the conveyor 31 are connected to the suction intake of the blower 76 by the air withdrawing unit 49 as soon as they begin to travel along the concave inner side of the shroud 48. The valves **88*a* and 88*b* are preferably adjusted in such a way that the pressure in the compartments 46*b* of successive chambers or recesses 46 is at least slightly (and preferably substantially) lower than in the associated compartments 46*a*. The outlet of the blower 76 admits compressed testing fluid into the groove 62 of the valve plate 61, and the compressed fluid flows into the adjacent ends of successive wrappers as soon as such wrappers enter the testing station between the grooves 62 and 69. The length of the groove 69 (as considered in the circumferential direction of the conveyor 31) is less than the distance between the axes of two neighboring cigarettes Z on the main body portion 42. The testing fluid which issues from the right-hand ends of successive wrappers, as viewed in FIG. 2, is admitted in the groove 69 and is discharged into the atmosphere via pipe 82. The transducer 91 generates electric signals which are indicative of permeability of the wrappers at the testing station, and such signals are transmitted to the corresponding inputs of the threshold circuits 92 and 93. The signals at the output of the transducer 91 are indicative of pressure in the pipe 82, and such pressure is a function of permeability of the wrappers, i.e., the pressure in the pipe 82 is less if a wrapper between the pipes 77 and 78 has an open seam, one or more large holes, one or more frayed ends and/or other defects which allow a relatively large amount of testing fluid to flow into the respective compartments 46***a* and 46*b*.

The outputs of the circuits 92 and 93 transmit signals to the OR-gate 97 when the permeability of wrappers is excessive and/or when the permeability of wrappers is too low. Such signals are transmitted to the AND-gate 98 which transmits signals on to the first stage of the shift register 101. The latter transports the signals at a speed corresponding to the speed of sidewise movement of the respective defective cigarettes Z to the ejecting station on the conveyor 32. The valve 104 opens and admits compressed air into the nozzle 107 whenever a defective cigarette reaches the ejecting station. This station is preferably located ahead of the aforementioned device which tests the density of tobacco-containing ends of cigarettes on the conveyor 32 so that the nozzle 107 can be used to segregate cigarettes which are defective due to unsatisfactory density of their tobacco-containing ends and/or cigarettes having defective wrappers. The pulse generator 99 insures that the signals denoting defective cigarettes are transmitted to the first stage of the shift register 101 and are thereupon transported to the ejecting station in synchronism with movement of the respective defective cigarettes into the range of the nozzle 107.

In the apparatus of FIG. 4, the first testing device of the apparatus (such device includes the compartments 46*a* and the associated elements of the unit 49) establishes a pressure differential mainly between the interior and exterior of the first or major portion of each wrapper (namely, that wrapper portion which forms part of the plain cigarette T) and the second testing device (including the compartments 46*b* and the associated parts of the unit 49) establishes a pressure differential primarily between the interior and exterior of predetermined second portions of successive wrappers, namely, those wrapper portions which are provided with the holes L. As a rule, the cause of excessive permeability will be found in the first wrapper portions which form part of the plain cigarettes T and the cause of insufficient permeability will be found in the second portions of the wrappers (including the perforated portions). Since the pressure differential between the interior of wrapper portions forming part of the filter mouthpieces F and the respective compartments 46*b* is much more pronounced than the pressure differential between the inner portions of wrappers of the plain cigarettes T and the compartments 46*a*, the second testing device is more sensitive (i.e., it monitors the permeability with a higher degree of accuracy) than the first testing device. This does not affect the quality of the testing operation since the presence of minor defects (e.g., relatively small holes) in the wrappers of plain cigarettes T is not as serious (or is presently not considered to be as serious) as insufficient permeability or perforated wrapper portions which serve to admit predetermined quantities of cool atmospheric air into the column of tobacco smoke.

The average permeability of a predetermined number of successive wrappers can be ascertained by looking at the position of the pointer in the high-inertia pressure gauge 84 which is connected with or installed in the pipe 82. If the prime mover PM drives the moving parts of the filter cigarette making machine at an optimum speed (e.g., so that the machine turns out 4,000 cigarettes Z per minute), the number of wrappers whose average permeability is indicated by the position of the pointer in the gauge 84 is constant and can be readily ascertained because the inertia of the gauge 84 constitutes a time constant. The measuring circuit 86 can be said to include two measuring means which respectively form part of the first and second testing devices and respectively include the parts 92, 94 and 93, 96. This measuring circuit insures that each cigarette whose wrapper exhibits excessive or insufficient permeability is invariably segregated from satisfactory cigarettes. As stated before, the cause of excessive permeability is normally the wrapper portion which surrounds the plain cigarette T and the cause of insufficient permeability is normally the wrapper portion which surrounds the mouthpiece F.

FIG. 5 shows a portion of a modified testing apparatus wherein all such parts which are identical with or clearly analogous to corresponding parts of the apparatus of FIG. 4 are designated by similar reference characters plus 100. The main difference between the two apparatus is that the pipe 77 of FIG. 4 is omitted, together with the valve plate 61 and bores 57 in the flange 56 (i.e., the flange 56 simply seals the respective ends of wrappers on the conveyor including the main body portion 142). The intake of the pipe 182 communicates with the atmosphere, i.e., the testing fluid (air) which the pipe 182 admits into the respective ends of successive wrappers is maintained at atmospheric pressure. The pressure in the pipe 182 downstream of the flow restrictor 183 fluctuates in dependency on deviations of permeability of successive wrappers from a desired optimum value, and the transducer of the measuring circuit 186 furnishes appropriate electric or pneumatic signals to the associated threshold circuits. The blower 176 of FIG. 5 serves solely as a suction generating device which enables the pipe 187 to evacuate air from successive aligned compartments 146*a*, 146*b* at a rate which is determined by setting of the pressure regulating valves 188*a* and 188*b*.

The only important difference between the measuring circuits 86 and 186 is that the intensity of pneumatic signals which are transmitted to the input of the transducer in the circuit 186 is indicative of pressures below atmospheric pressure whereas the input of the transducer 91 receives signals whose intensity is indicative of a pressure exceeding atmospheric pressure. Otherwise stated, the apparatus of FIG. 4 comprises means for blowing testing fluid into the interior of successive wrappers whereas the apparatus of FIG. 5 includes means for sucking testing fluid into the wrappers which advance past the groove 69 of the valve plate 68 (not shown in FIG. 5).

An important advantage of the improved method and apparatus is that a single testing operation suffices to detect all cigarettes wherein the permeability of wrappers (or at least the major portions of wrappers) is excessive as well as all cigarettes wherein the so-called climatic zones of the wrappers do not permit adequate quantities of air to flow into the column of tobacco smoke. Furthermore, such simultaneous detection of cigarettes whose wrappers are defective for two different reasons can be effected with desired degrees of accuracy, i.e., preferably with a higher degree of accuracy in connection with the testing of climatic zones and preferably with a lesser degree of accuracy for the remaining portions of wrappers. An additional advantage of the improved method and apparatus is that the testing operation can be performed at the rate at which the cigarettes Z are produced in the machine as well as that the apparatus occupies little room so that it can be readily installed in existing machines for the production of rod-shaped articles which constitute or form part of smokers' products.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. A method of testing the wrappers of cigarettes or analogous rod-shaped articles which constitute or form part of smoker's products, comprising the steps of measuring, with a first degree of accuracy, the permeability of a first portion of the wrapper of each of a series of successive articles; measuring, with a higher second degree of accuracy, the permeability of a second portion of the wrapper of each of said series of articles, said second portion of the wrapper having air admitting holes therein, said first mentioned measuring step including establishing a first pressure differential between the interior and exterior of successive first wrapper portions and said last mentioned measuring step including establishing a different second pressure differential between the interior and exterior of successive second wrapper portions; generating a succession of first signals having characteristics denoting the measured permeabilities of first and second portions of wrappers of successive articles; comparing each of said first signals with a first reference signal denoting the maximum permissible permeability of said wrappers; and comparing each of said first signals with a second reference signal denoting the minimum acceptable permeability of said wrappers.

2. A method as defined in claim 1, wherein said second pressure differential is more pronounced than said first pressure differential.

3. A method as defined in claim 1, wherein said first signals are pneumatic signals.

4. A method as defined in claim 1, wherein said first signals are electric signals.

5. A method as defined in claim 1, further comprising the step of segregating from said series those articles wherein the permeability of wrappers exceeds said maximum permissible permeability.

6. A method as defined in claim 5, further comprising the step of moving the rod-shaped articles of said series in a direction transverse to the axes of the articles along a predetermined path in the course of said measuring steps, said segregating step including generating an additional signal whenever the intensity of a first signal exceeds the intensity of said first reference signal, and utilizing said additional signals for ejection of the respective articles from said path.

7. A method as defined in claim 1, further comprising the step of segregating from said series those articles wherein the permeability of wrappers is below said minimum acceptable permeability.

8. A method as defined in claim 7, further comprising the step of moving the rod-shaped articles of said series in a direction transverse to the axes of the articles along a predetermined path in the course of said measuring steps, said segregating step including generating an additional signal whenever the intensity of a first signal is less than the intensity of said second reference signal, and utilizing said additional signals for ejection of the respective articles from said path.

9. Apparatus for testing the wrappers of rod-shaped articles which constitute or form part of smokers' products, comprising means for moving a series of articles along a predetermined path; first and second testing devices adjacent to said path and respectively including means for establishing different first and second pressure differentials between bodies of testing fluid in the interior and at the exterior of first and second portions of wrappers of succesive articles of said series, said second portions of wrappers having air admitting holes therein and said second pressure differential being more pronounced than said first pressure differential; means for generating first signals denoting the rate of fluid flow through the first and second portions of successive wrappers, such rate being indicative of permeability of the respective wrappers; and means for comparing said first signals with first and second reference signals which respectively denote the maximum permissible and minimum acceptable permeability of wrappers.

10. Apparatus as defined in claim 9, wherein said moving means comprises an endless conveyor having chambers for discrete articles, each of said chambers including a first compartment for the first portion and a second compartment for the second portion of the respective wrapper, and further comprising suction generating means, said first and second testing devices respectively comprising means for connecting said suction generating means with said first and second compartments.

11. Apparatus as defined in claim 10, wherein at least one of said testing devices further comprises means for maintaining the pressure in said first compartments above the pressure in said second compartments.

12. Appartus as defined in claim 9, wherein said signal generating means includes an electropneumatic transducer.

13. Apparatus as defined in claim 12, wherein said comparing means comprises two threshold circuits having first inputs connected with the output of said transducer and second inputs respectively arranged to receive said first and second reference signals.

14. Apparatus as defined in claim 9, further comprising means for segregating from said series those articles wherein the permeability of wrappers exceeds said maximum permissible permeability.

15. Apparatus as defined in claim 14, wherein said comparing means comprises means for generating additional signals denoting articles wherein the permeability of wrappers exceeds said maximum permissible permeability, said segregating means comprising means for expelling the last mentioned articles from said path in response to said additional signals.

16. Apparatus as defined in claim 9, wherein said first and second testing devices are adjacent to one and the same portion of said path.

17. Apparatus as defined in claim 9, wherein said testing devices comprise means for admitting compressed testing fluid into the interior of said wrappers and means for withdrawing air from the areas surrounding said wrappers.

18. Apparatus as defined in claim 9, wherein said testing devices include means for reducing the pressure around the wrappers to less than atmospheric pressure.

19. Apparatus as defined in claim 9, further comprising means for segregating from said series those articles wherein the permeability of wrappers is below said minimum acceptable permeability.

20. Apparatus as defined in claim 19, wherein said comparing means comprises means for generating additional signals denoting articles wherein the permeability of wrappers is below said minimum acceptable permeability, said segregating means comprising means for expelling the last mentioned articles from said path in response to said additional signals.

21. Apparatus as defined in claim 9, wherein said moving means comprises means for conveying several rows of articles sideways and inserting the articles of one of said rows between the articles of another of said rows to form said series.

22. Apparatus as defined in claim 21, further comprising means for inverting the articles of said one row prior to insertion between the articles of said other row.

* * * * *